US009801474B2

(12) United States Patent
Trulaske, Sr.

(10) Patent No.: US 9,801,474 B2
(45) Date of Patent: Oct. 31, 2017

(54) EDGE-LIT DOOR FOR REFRIGERATOR UNIT

(71) Applicant: True Manufacturing Co., Inc., O'Fallon, MO (US)

(72) Inventor: Steven Lee Trulaske, Sr., St. Louis, MO (US)

(73) Assignee: TRUE MANUFACTURING CO., INC., O'Fallon, MO (US)

( * ) Notice: Subject to any disclaimer, the term of this patent is extended or adjusted under 35 U.S.C. 154(b) by 0 days.

(21) Appl. No.: 14/861,419

(22) Filed: Sep. 22, 2015

(65) Prior Publication Data

US 2016/0095450 A1 Apr. 7, 2016

Related U.S. Application Data

(60) Provisional application No. 62/058,196, filed on Oct. 1, 2014.

(51) Int. Cl.

| | |
|---|---|
| ***A47F 3/04*** | (2006.01) |
| ***A47F 3/00*** | (2006.01) |
| ***F21V 33/00*** | (2006.01) |
| ***A47F 11/10*** | (2006.01) |
| ***F25D 27/00*** | (2006.01) |
| *F21W 131/305* | (2006.01) |

(52) U.S. Cl.

CPC ..... *A47F 3/001* (2013.01); *A47F 3/005* (2013.01); *A47F 3/043* (2013.01); *A47F 3/0434* (2013.01); *A47F 11/10* (2013.01); *F21V 33/0044* (2013.01); *F25D 27/00* (2013.01); *F21W 2131/305* (2013.01)

(58) Field of Classification Search

CPC ..... F21V 33/0044; F21W 2131/035; A47F 3/001; A47F 3/005; A47F 3/043; A47F 3/0434

USPC ..... 312/116, 405

See application file for complete search history.

(56) References Cited

U.S. PATENT DOCUMENTS 4,449,761 A 5/1984 Davis et al.
4,886,327 A * 12/1989 Amstutz ..... A47F 3/005 312/114

(Continued)

FOREIGN PATENT DOCUMENTS

KR 101349159 1/2014
WO WO 2014/069791 * 5/2014

OTHER PUBLICATIONS

Patent Cooperation Treaty, International Search Report for PCT/US2015/051333, dated Dec. 23, 2015, 3 pages.

*Primary Examiner* — Daniel J Troy
*Assistant Examiner* — Timothy M Ayres
(74) *Attorney, Agent, or Firm* — Bryan Cave LLP

(57) ABSTRACT

A door for a refrigeration unit having a transparent panel assembly having an outer transparent panel and an inner transparent panel. The outer transparent panel has an outer side, an inner side, and top, bottom, left, and right edges and the inner transparent panel has an outer side, an inner side and top, bottom, left, and right edges. A decorative design is applied to the inner side of the outer transparent panel. A population of light sources are positioned on the top, bottom, left and/or right edges of the outer transparent panel and are capable of emitting light into the outer transparent panel, such that the decorative design is capable of being illuminated by the population of light sources.

43 Claims, 9 Drawing Sheets

(56) References Cited

U.S. PATENT DOCUMENTS

| | | | | |
|---|---|---|---|---|
| 5,027,258 | A | 6/1991 | Schoniger et al. | |
| 5,363,611 | A * | 11/1994 | Richardson | A47F 3/043 312/116 |
| 5,555,654 | A | 9/1996 | Hermann | |
| 5,613,751 | A | 3/1997 | Parker et al. | |
| 5,699,676 | A | 12/1997 | Trulaske, Sr. | |
| 5,783,264 | A | 7/1998 | Howes | |
| 5,879,070 | A | 3/1999 | Severloh | |
| 5,937,666 | A | 8/1999 | Trulaske, Sr. | |
| 5,944,862 | A | 8/1999 | Howes | |
| 6,059,420 | A | 5/2000 | Rogers | |
| 6,148,563 | A | 11/2000 | Roche et al. | |
| 6,210,013 | B1 | 4/2001 | Bousfield | |
| 6,406,108 | B1 * | 6/2002 | Upton | A47F 3/0434 312/116 |
| 6,568,821 | B1 | 5/2003 | Page et al. | |
| 7,246,932 | B2 * | 7/2007 | Burtsev | G02B 6/0001 362/23.16 |
| 7,358,929 | B2 | 4/2008 | Mueller et al. | |
| 7,364,342 | B2 | 4/2008 | Parker et al. | |
| 7,467,887 | B2 | 12/2008 | Parker | |
| 7,492,346 | B2 | 2/2009 | Manabe et al. | |
| 7,736,043 | B2 | 6/2010 | Parker | |
| 8,092,068 | B2 | 1/2012 | Parker et al. | |
| 8,123,393 | B2 | 2/2012 | Parker | |
| 8,142,063 | B2 | 3/2012 | Parker | |
| 8,215,816 | B2 | 7/2012 | Parker | |
| 8,322,905 | B2 | 12/2012 | Parker et al. | |
| 8,439,461 | B2 | 5/2013 | Kim | |
| 8,523,374 | B2 | 9/2013 | Pae | |
| 8,523,375 | B2 | 9/2013 | Kim et al. | |
| 8,556,440 | B2 | 10/2013 | Hong | |
| 8,608,330 | B2 | 12/2013 | Kim | |
| 2008/0024047 | A1 | 1/2008 | Juo et al. | |
| 2008/0148753 | A1 | 6/2008 | Welker et al. | |
| 2009/0244884 | A1 | 10/2009 | Trulaske, Sr. | |
| 2010/0180615 | A1 | 7/2010 | Linder et al. | |
| 2010/0242515 | A1 | 9/2010 | Kim | |
| 2012/0031124 | A1 | 2/2012 | McDaniel | |
| 2013/0063326 | A1 | 3/2013 | Riegel | |
| 2013/0119847 | A1 | 5/2013 | Seo et al. | |
| 2014/0144083 | A1 | 5/2014 | Artwohl et al. | |

* cited by examiner

EDGE-LIT DOOR FOR REFRIGERATOR UNIT

CROSS-REFERENCE TO RELATED APPLICATIONS

This application claims priority to, and incorporates by reference, U.S. provisional patent application Ser. No. 62/058,196, filed Oct. 1, 2014.

FIELD OF THE DISCLOSURE

This disclosure relates generally to refrigerator units and, more particularly, to refrigerator units that include an edge-lit door having a decorative design thereon.

BACKGROUND

The principal components of a typical refrigerator unit, such as those used in residential, commercial and industrial applications, include a storage compartment which is refrigerated by a refrigeration system and is used to store and/or display various food products and beverages at low temperatures. One or more doors having a transparent portion through which the food products and beverages can be viewed are typically rotatably or slidably attached to the refrigerator unit. The door(s) may be opened to access the food products and/or beverages stored in the refrigerator unit. When closed, the door(s) seal the storage compartment thereby assisting in keeping the food products and/or beverages at reduced temperatures. Such refrigeration units typically include decorative designs to attract the attention of potential purchasers of the food products and/or beverages stored within the refrigeration unit.

The present disclosure is directed to a door including a transparent panel on which a decorative design is applied and is edge-lit such that the design illuminates to attract potential purchasers.

SUMMARY OF THE DISCLOSURE

Briefly, therefore, one embodiment of the disclosure is directed to a door for a refrigeration unit having a transparent panel assembly comprising an outer transparent panel and an inner transparent panel. The outer transparent panel has an outer side, an inner side, and top, bottom, left, and right edges and the inner transparent panel has an outer side, an inner side and top, bottom, left, and right edges. A decorative design is applied to the inner side of the outer transparent panel. A population of light sources are positioned on the top, bottom, left and/or right edges of the outer transparent panel and are capable of emitting light into the outer transparent panel, such that the decorative design is capable of being illuminated by the population of light sources.

Another embodiment of the disclosure is directed to a door for a refrigeration unit having a transparent panel assembly comprising an outer transparent panel and an inner transparent panel. The outer transparent panel has an outer side, an inner side, and top, bottom, left, and right edges and the inner transparent panel has an outer side, an inner side and top, bottom, left, and right edges. A decorative design is applied to the inner side of the inner transparent panel. A population of light sources are positioned on the top, bottom, left and/or right edges of the inner transparent panel and are capable of emitting light into the inner transparent panel, such that the decorative design is capable of being illuminated by the population of light sources.

Another embodiment of the disclosure is directed to a door for a refrigeration unit having a transparent panel assembly comprising outer and inner transparent panels. The outer transparent panel has an outer side, an inner side, and top, bottom, left, and right edges, wherein a first decorative design is applied to the inner side of the outer transparent panel. The inner transparent panel has an outer side, an inner side, and top, bottom, left, and right edges, wherein a second decorative design is applied to the inner side of the inner transparent panel. A first population of light sources are positioned on the top, bottom, left and/or right edges of the outer transparent panel and are capable of emitting light into the outer transparent panel. A second population of light sources are positioned on the top, bottom, left and/or right edges of the inner transparent panel and are capable of emitting light into the inner transparent panel. The first decorative design is capable of being illuminated by the first population of light sources, and the second decorative design is capable of being illuminated by the second population of light sources.

Another embodiment of the disclosure is directed to a door for a refrigeration unit having a rectangular door shell and a perimeter channel located in the door shell, the perimeter channel having a front wall, a rear wall, and a perimeter wall. A transparent panel assembly is retained within the perimeter channel. The transparent panel assembly includes an outer transparent panel having an outer side, an inner side, and top, bottom, left, and right edges, an inner transparent panel having an outer side, an inner side, and top, bottom, left, and right edges, and a spacer bar proximate the top, bottom, left, and right edges of the outer and inner transparent panels. The spacer bar connects the inner sides of the outer and inner transparent panels. A population of light sources are positioned on the top, bottom, left and/or right edges of the outer and/or inner transparent panels and are capable of emitting light into the outer and/or inner transparent panels. A population of light source retention members contact the population of light sources, and a population of springs contact the population of light source retention members and the perimeter wall of the perimeter channel. The population of springs provides a spring force to maintain the population of light sources in contact with the top, bottom, left and/or right edges of the outer and/or inner transparent panels.

Yet another embodiment of the disclosure is directed to a refrigeration unit comprising a cabinet having a storage compartment and refrigeration system components capable of refrigerating the storage compartment and a door mounted to the cabinet. The door has a transparent panel assembly comprising an outer transparent panel and an inner transparent panel. The outer transparent panel has an outer side, an inner side, and top, bottom, left, and right edges and the inner transparent panel has an outer side, an inner side and top, bottom, left, and right edges. A decorative design is applied to the inner side of the outer transparent panel. A population of light sources are positioned on the top, bottom, left and/or right edges of the outer transparent panel and are capable of emitting light into the outer transparent panel, such that the decorative design is capable of being illuminated by the population of light sources.

Yet another embodiment of the disclosure is directed to a refrigeration unit comprising a cabinet having a storage compartment and refrigeration system components capable of refrigerating the storage compartment and a door mounted to the cabinet. The door has a transparent panel assembly comprising an outer transparent panel and an inner transparent panel. The outer transparent panel has an outer side, an inner side, and top, bottom, left, and right edges and the inner transparent panel has an outer side, an inner side and top, bottom, left, and right edges. A decorative design is applied to the inner side of the inner transparent panel. A population of light sources are positioned on the top, bottom, left and/or right edges of the inner transparent panel and are capable of emitting light into the inner transparent panel, such that the decorative design is capable of being illuminated by the population of light sources.

Yet another embodiment of the disclosure is directed to a refrigeration unit comprising a cabinet having a storage compartment and refrigeration system components capable of refrigerating the storage compartment and a door mounted to the cabinet. The door has a transparent panel assembly comprising outer and inner transparent panels. The outer transparent panel has an outer side, an inner side, and top, bottom, left, and right edges, wherein a first decorative design is applied to the inner side of the outer transparent panel. The inner transparent panel has an outer side, an inner side, and top, bottom, left, and right edges, wherein a second decorative design is applied to the inner side of the inner transparent panel. A first population of light sources are positioned on the top, bottom, left and/or right edges of the outer transparent panel and are capable of emitting light into the outer transparent panel. A second population of light sources are positioned on the top, bottom, left and/or right edges of the inner transparent panel and are capable of emitting light into the inner transparent panel. The first decorative design is capable of being illuminated by the first population of light sources, and the second decorative design is capable of being illuminated by the second population of light sources.

Yet another embodiment of the disclosure is directed to a refrigeration unit comprising a cabinet having a storage compartment and refrigeration system components capable of refrigerating the storage compartment and a door mounted to the cabinet. The door has a rectangular door shell and a perimeter channel located in the door shell, the perimeter channel having a front wall, a rear wall, and a perimeter wall. A transparent panel assembly is retained within the perimeter channel. The transparent panel assembly includes an outer transparent panel having an outer side, an inner side, and top, bottom, left, and right edges, an inner transparent panel having an outer side, an inner side, and top, bottom, left, and right edges, and a spacer bar proximate the top, bottom, left, and right edges of the outer and inner transparent panels. The spacer bar connects the inner sides of the outer and inner transparent panels. A population of light sources are positioned on the top, bottom, left and/or right edges of the outer and/or inner transparent panels and are capable of emitting light into the outer and/or inner transparent panels. A population of light source retention members contact the population of light sources, and a population of springs contact the population of light source retention members and the perimeter wall of the perimeter channel. The population of springs provides a spring force to maintain the population of light sources in contact with the top, bottom, left and/or right edges of the outer and/or inner transparent panels.

Other objects and features will be in part apparent and in part pointed out hereinafter.

BRIEF DESCRIPTION OF THE FIGURES

These and other features, aspects and advantages of the disclosure will become more fully apparent from the following detailed description, appended claims, and accompanying drawings, wherein the drawings illustrate features in accordance with exemplary embodiments of the disclosure, and wherein:

DETAILED DESCRIPTION

Before any embodiments of the disclosure are explained in detail, it will be understood that the disclosure is not limited in its application to the details of construction and the arrangement of components set forth in the following description or illustrated in the following drawings. The disclosure is capable of other embodiments and of being practiced or of being carried out in various ways. Also, it will be understood that the phraseology and terminology used herein is for the purpose of description and should not be regarded as limiting. The use of "including," "comprising," or "having" and variations thereof herein is meant to encompass the items listed thereafter and equivalents thereof as well as additional items. All numbers expressing measurements and so forth used in the specification and claims are to be understood as being modified in all instances by the term "about." It should also be noted that any references herein to front and back, right and left, top and bottom and upper and lower are intended for convenience of description, not to limit an disclosure disclosed herein or its components to any one positional or spatial orientation.

Figure 1:
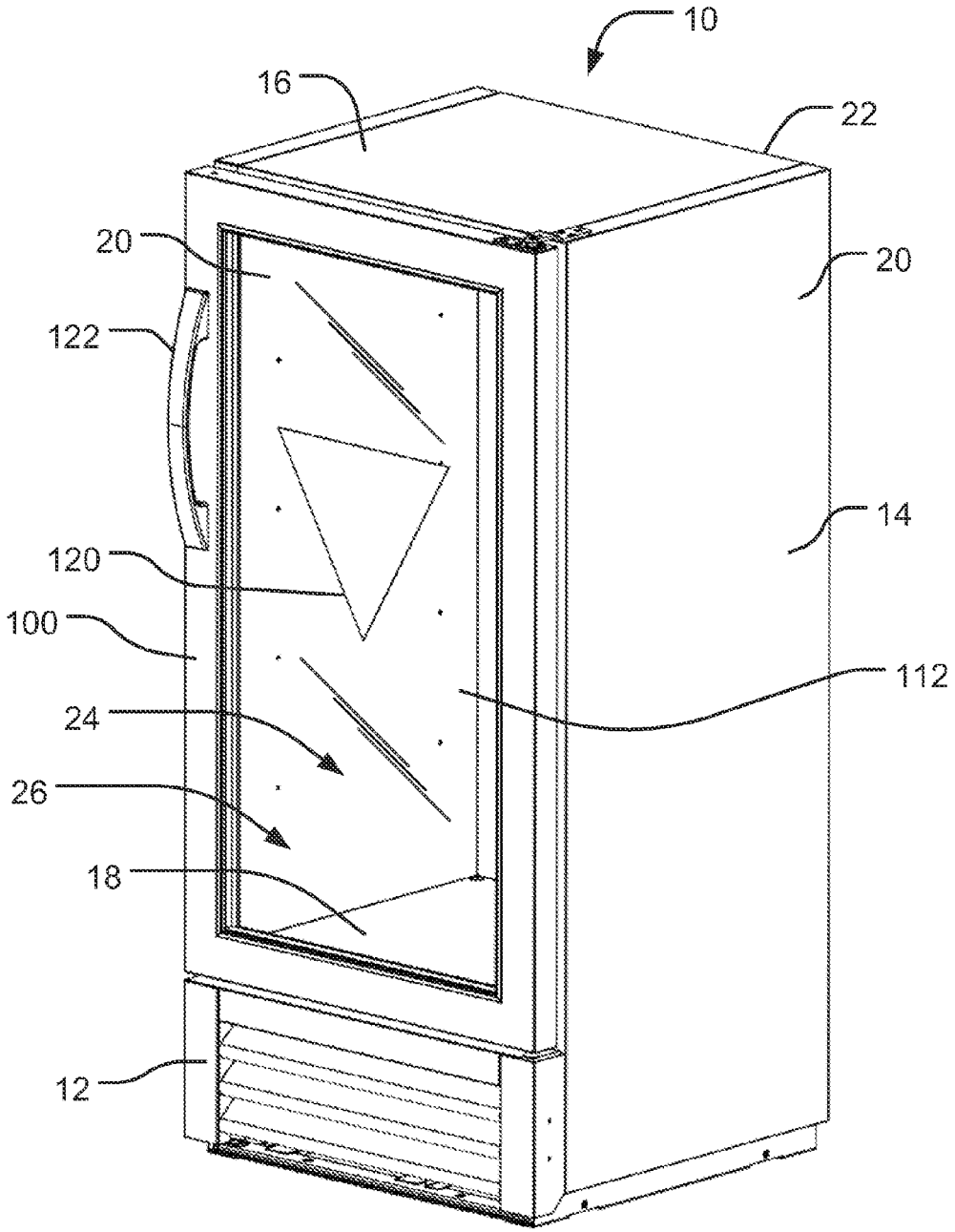
FIG. 1 is a right perspective view of a refrigerator unit according to one embodiment of the disclosure.
Figure 2:
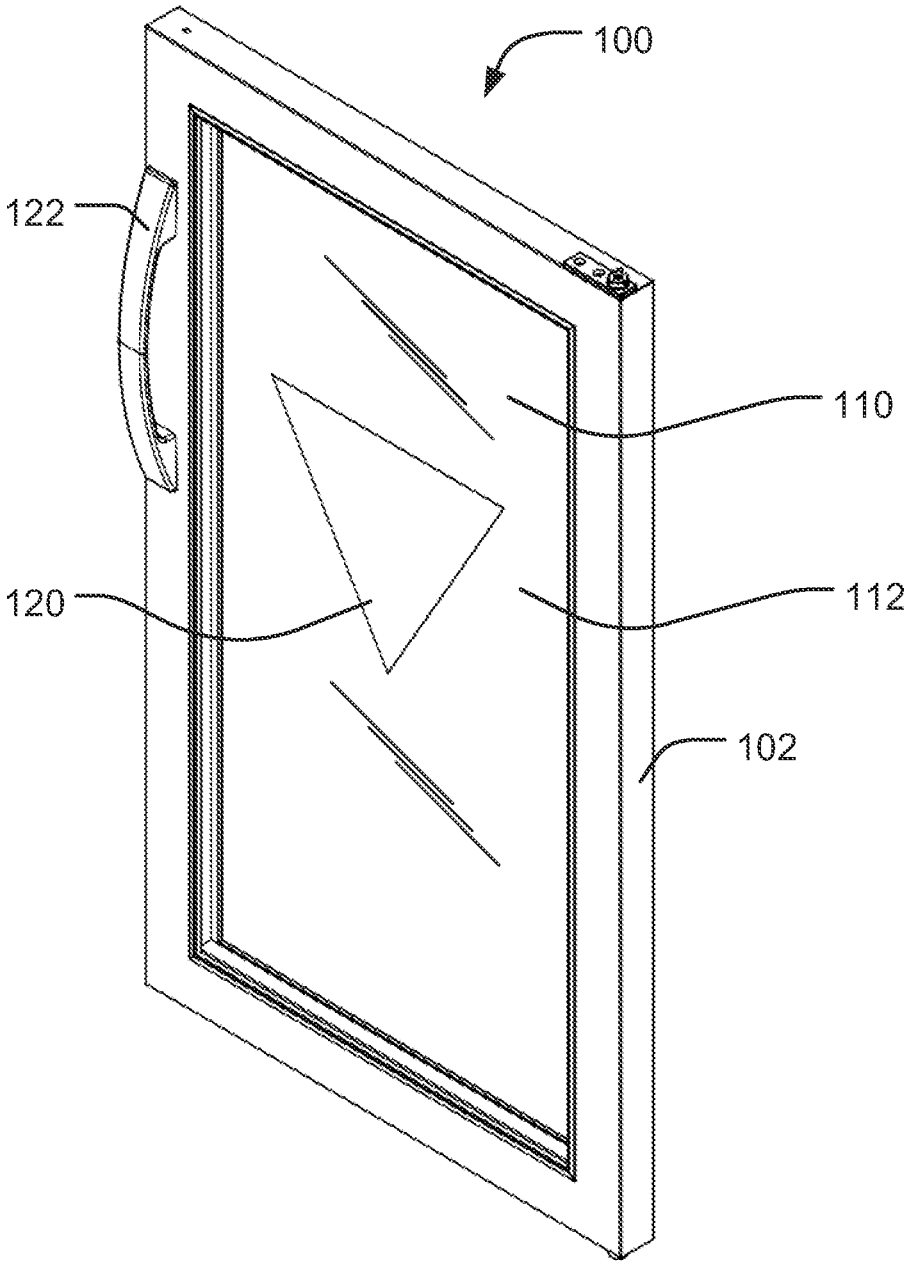
FIG. 2 is a right perspective view of a door for a refrigerator unit according to one embodiment of the disclosure.
Figure 3:
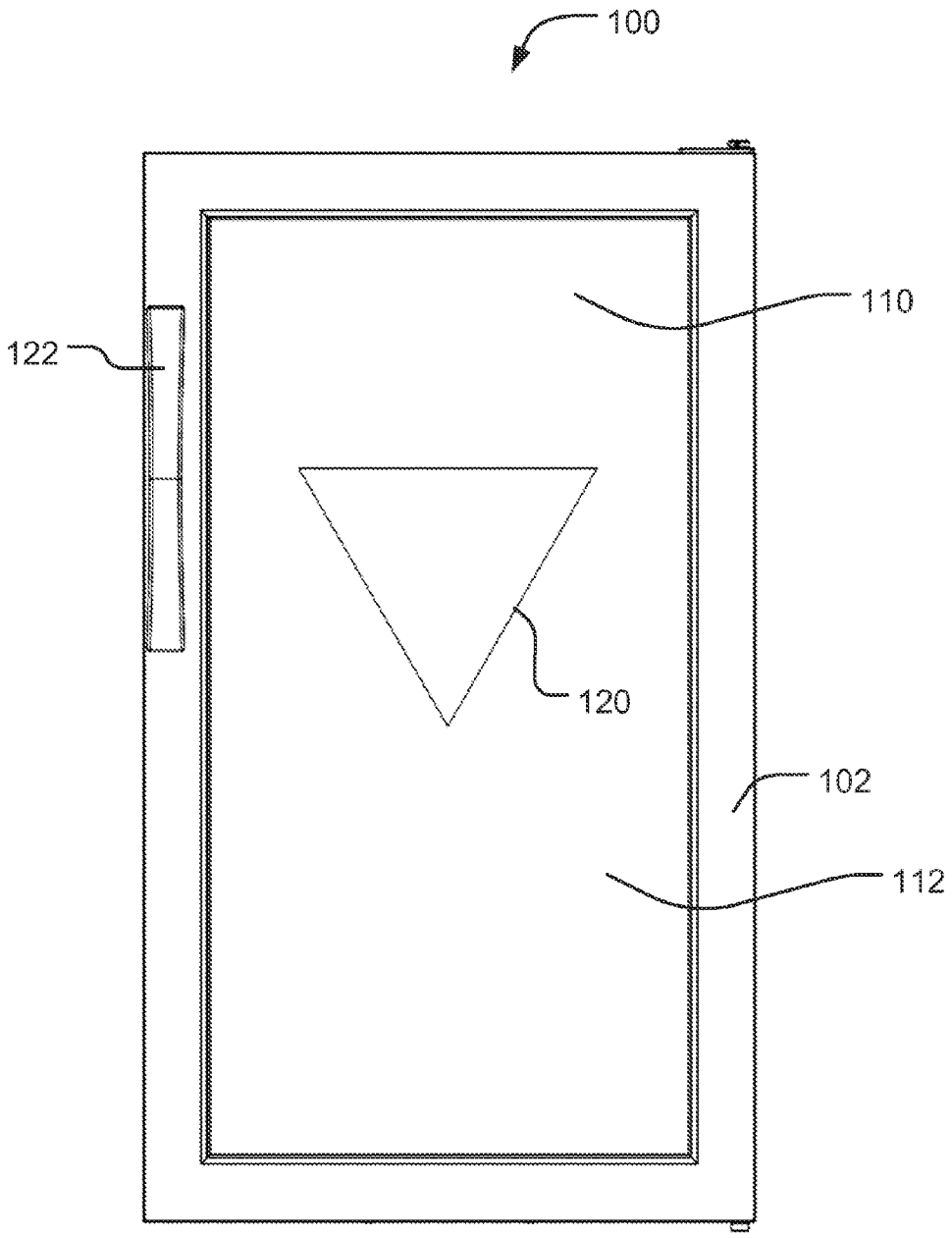
FIG. 3 is a front view of a door for a refrigerator unit according to one embodiment of the disclosure.
Figure 4:
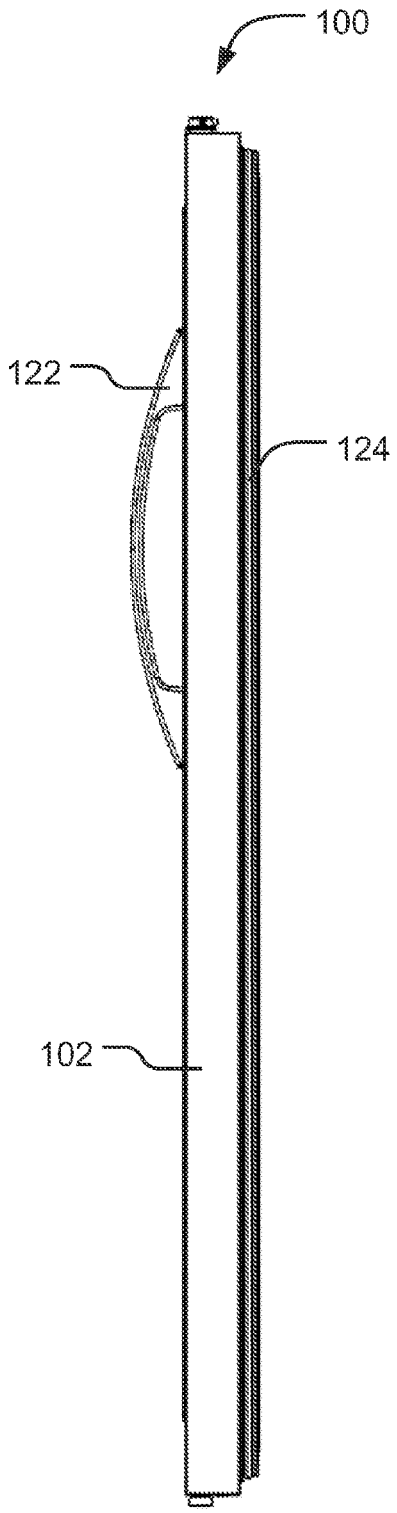
FIG. 4 is a right view of a door for a refrigerator unit according to one embodiment of the disclosure.
Figure 5:
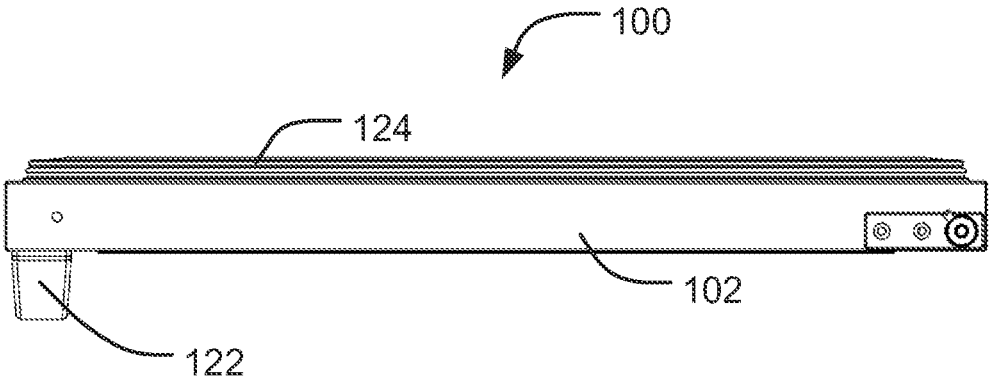
FIG. 5 is a top view of a door for a refrigerator unit according to one embodiment of the disclosure.

As illustrated in FIG. 1, one embodiment of the disclosure is a refrigerator unit 10 having a refrigeration system disposed within refrigerator unit 10. In certain embodiments, for example, refrigerator unit 10 may be a glass door merchandiser which may be used to store and display products such as food and/or drinks for sale. However, it will be understood that refrigerator unit 10 may be any type of refrigeration unit, including, but not limited to, residential, commercial and/or industrial refrigerators, vending machines, etc. Refrigerator unit 10 may include a cabinet 14 having a lower portion providing a refrigeration system housing 12 and an upper portion providing a storage compartment 24. As shown, cabinet 14 includes a top 16, a bottom 18, opposed sides 20 and a back 22 defining storage compartment 24 having an opening 26. Some or all of components of a refrigeration system (not shown) for keeping storage compartment 24 cold may be disposed within refrigeration system housing 12. Opening 26, in the embodiment shown, is closed by a door 100. Door 100 is attached to one of said cabinet sides 20 in swinging relation to said opening 26. While certain embodiments include a single door 100, it will be understood by one of ordinary skill in the art that any number of doors may be used without departing from the scope of the disclosure. Although door 100 is described as rotatably affixed to cabinet 14, in other embodiments, for example, one or more cabinet 14 may include one or more sliding doors. That is, one or more doors may be slidably affixed to cabinet 14.

Figure 6:
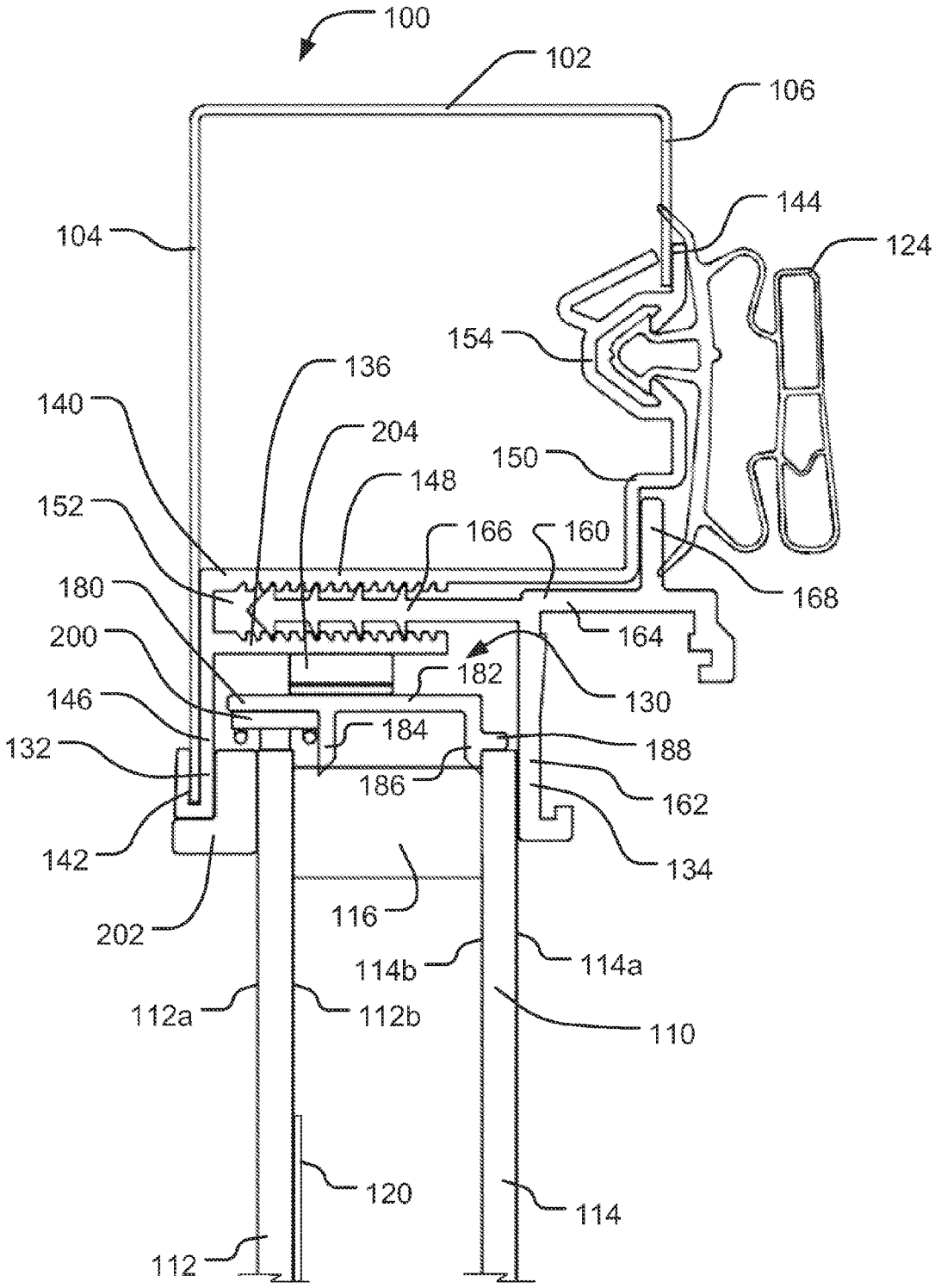
FIG. 6 is a right section view of a door for a refrigerator unit according to one embodiment of the disclosure.

With reference to FIGS. 2-5, door 100 comprises door shell 102 in which a transparent panel assembly 110 having decorative design 120 is attached. Door 100 may further include handle 122 for opening door. When door 100 is closed, perimeter gasket 124 seals storage compartment 24. Door shell 120 may be filled with insulation, such as, for example, an open- or closed-cell foam. As illustrated in FIG. 6, transparent panel assembly 110 is made of an outer transparent panel 112 and an inner transparent panel 114.

Figure 7:
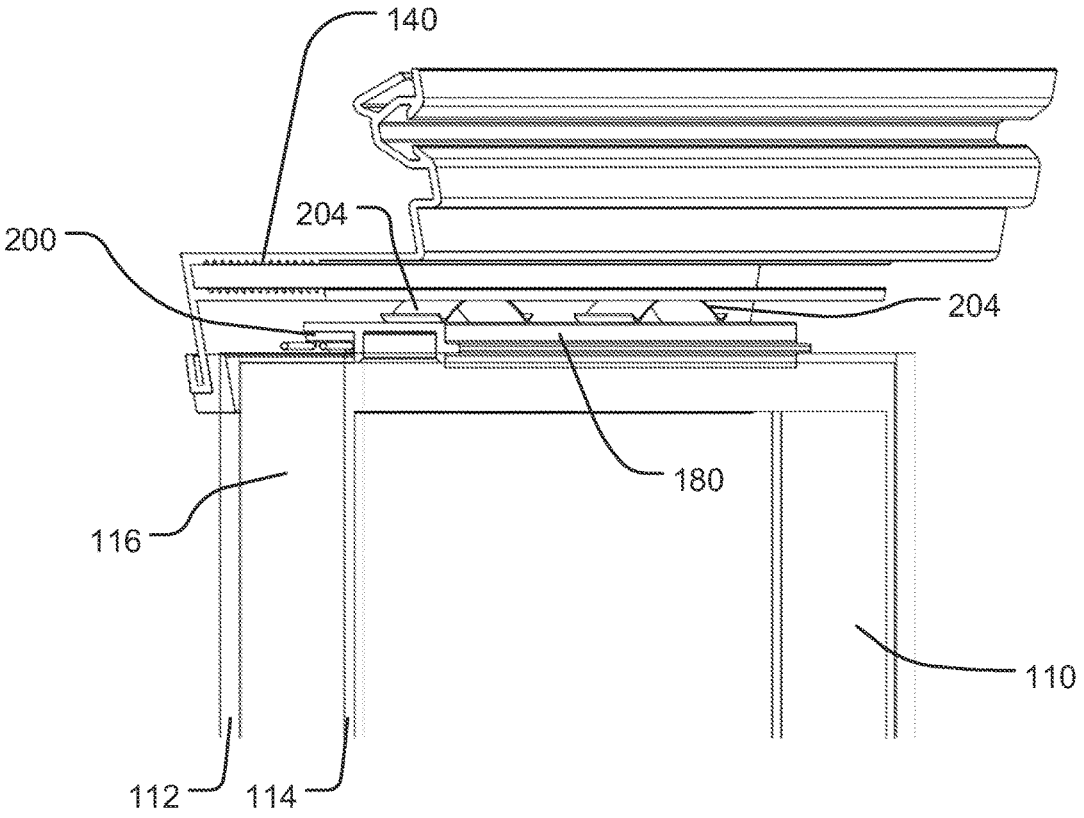
FIG. 7 is a right rear perspective view of portions of a door for a refrigerator unit according to one embodiment of the disclosure.

As shown in FIGS. 6 and 7, outer transparent panel 112 includes an outer side 112*a* and an inner side 112*b*. Inner transparent panel 114 includes an inner side 114*b* and an outer side 114*a*. Outer transparent panel 112 and inner transparent panel 114 are separated and sealed by spacer bar 116. Spacer bar 116 is proximate the top, bottom, left, and right edges of outer and inner transparent panels 112, 114. Spacer bar 116 connects inner sides 112*b*, 114*b* of outer and inner transparent panels 112, 114. Spacer bar 116 may be made of, for example, hot melt butyl, foam, rubber, or plastic and may also include a desiccant for reducing or eliminating condensation between outer and inner transparent panels 112, 114. The interior space between inner side 112*b* of outer transparent panel 112 and inner side 114*b* of inner transparent panel 114 is sealed and may be filled with an inert gas such as argon, or nitrogen. Outer and inner transparent panels 112, 114 are preferably glass; however, in other embodiments outer and inner transparent panels may be constructed of acrylic or other transparent material known in the art. A low-E coating may be applied to outer side 114*a* of inner transparent panel 114 in order to increase the insulating factor (R-value) of transparent panel assembly 110.

With reference to FIGS. 2-5, door 100 comprises door shell 102 in which a transparent panel assembly 110 having decorative design 120 is attached. Door 100 may further include handle 122 for opening door. When door 100 is closed, perimeter gasket 124 seals storage compartment 24. Door shell 102 may be filled with insulation, such as, for example, an open- or closed-cell foam. As illustrated in FIG. 6, transparent panel assembly 110 is made of an outer transparent panel 112 and an inner transparent panel 114.

Unlike prior art edge-lit signs in which the decorative design is etched into an acrylic transparent panel, in the preferred embodiment of the present disclosure decorative design 120 is applied directly to the inner side 112*b* of outer transparent panel 112, wherein outer transparent panel 112 is glass. Decorative design 120 may be printed on outer transparent panel 112 using a flatbed printer capable of printing ultraviolet (UV) curable inks. Flatbed printers manufactured by Electronics For Imaging, Inc. of Fremont, Calif. and sold under the brand name VUTEk® may be used.

Figure 8:
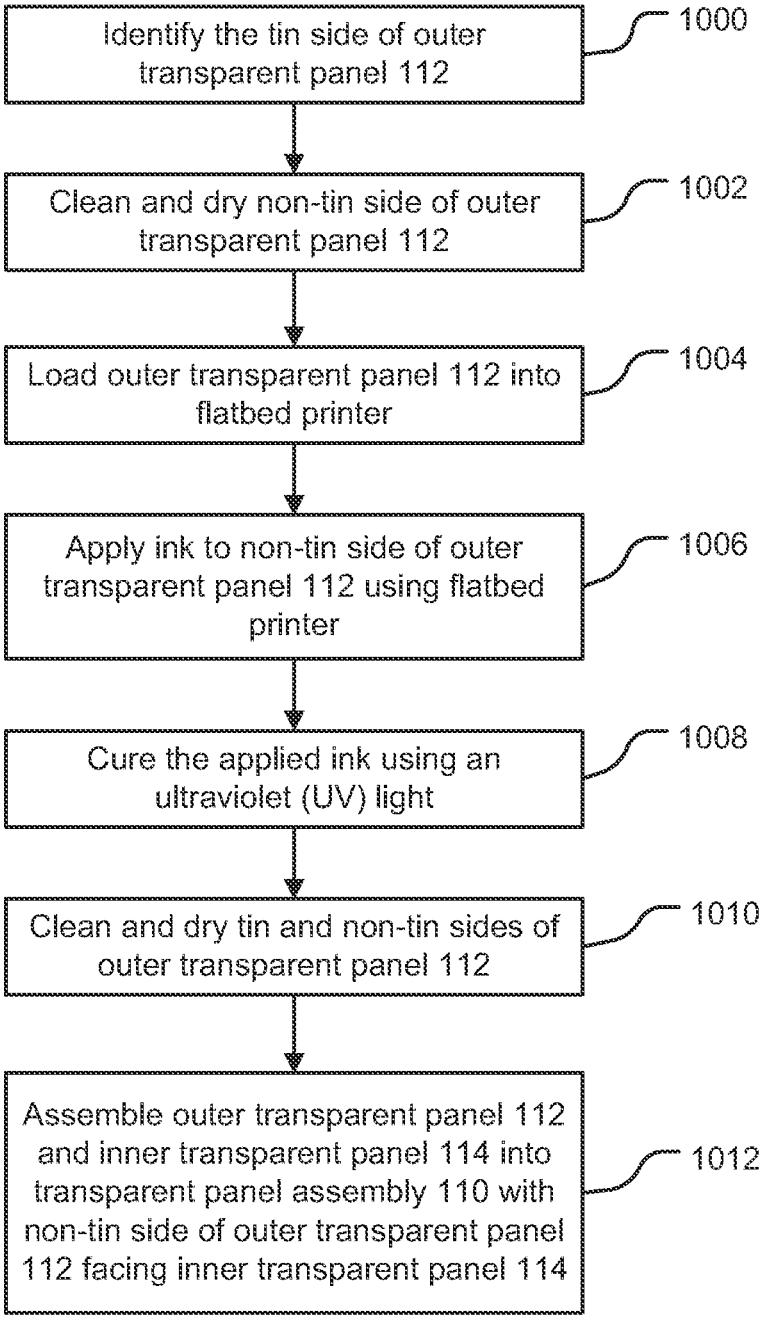
FIG. 8 is a flowchart of one method of applying a decorative design to a door for a refrigerator unit according to one embodiment of the disclosure.

Referring now to FIG. 8, one embodiment of a process for printing the decorative design 120 on inner side 112*b* of outer transparent panel 112 is shown. At step 1000, the tin side of outer transparent panel 112 is identified. During the manufacture of typical plate glass, one side of the glass is in contact with molten tin. It has been found that the inks used to print the decorative design 120 do not adhere as well to the tin side of outer transparent panel 112 as compared to the non-tin side. Therefore, a tin scope or tin detector may be used to identify the tin side of the outer transparent panel. At step 1002, at least the non-tin side of outer transparent panel 112 is cleaned and dried. At step 1004, outer transparent panel 112 is loaded into the flatbed printer. At step 1006, the flatbed printer applies ink to non-tin side of outer transparent panel 112 to form decorative design 120. At step 1008, after the ink is applied, an ultraviolet (UV) light in the flatbed printer cures the ink. That is, as outer transparent panel 112 moves through flatbed printer, the ink is applied and immediately after the ink is applied it is cured by an ultraviolet light (UV) in the flatbed printer. At step 1010, after the ink has cured on outer transparent panel 112, outer transparent panel 112 is cleaned again. Then at step 1012, outer transparent panel 112 and inner transparent panel 114 are assembled into transparent panel assembly 110 using multiple pane door and window manufacturing techniques known in the art. Preferably, as described more fully elsewhere herein, transparent panel assembly is assembled at step 1012 such that the non-tin side of outer transparent panel 112 on which decorative design 120 is applied faces inward toward inner transparent panel 114. That is, the non-tin side becomes inner side 112*b* of outer transparent panel 112. While various steps are described herein in one order, it will be understood that other embodiments of the method can be carried out in any order and/or without all of the described steps without departing from the scope of the disclosure.

Using white ink for decorative design 120 has been found to result in the best light reflection; however it will be understood that any color ink may be used for decorative design 120. While white ink is preferred, it has been found that white ink does not adhere to outer transparent panel 112 as well as inks of other colors. Accordingly, in embodiments where white ink is used, thorough cleaning and proper handling of outer transparent panel 112 is desired. Additionally, in certain embodiments, a primer may be applied to outer transparent panel 112 prior to the ink being applied. The primer and ink may be cured together to increase adhesion of the white ink to the primer and outer transparent panel 112. In other embodiments, for example, a faint or thin layer of ink of a first color may be applied to outer transparent panel 112 and cured. Then the white ink is applied on top of the first color ink and cured. Another faint or thin layer of the first color ink may then be optionally applied on top of the white ink and cured. The first color may be for example, the same color as the light source that is used to edge-light decorative design 120. For example, if green LEDs are used for edge-lighting decorative design, a faint or thin layer of green ink may be used.

In yet other embodiments, to aid in the adhesion of the white ink to outer transparent panel 112, after step 1008 but before step 1010, the white ink is allowed to further cure for a period of time at a certain temperature. For example, the white ink is further cured to outer transparent panel 112 for a period of time from about 8 hours to about 24 hours (e.g., 8 hours, 12 hours, 16 hours, 18 hours, 24 hours) at a temperature from about 68 degrees F. to about 75 degrees F. In other embodiments, for example, the white ink is further cured to outer transparent panel 112 for about 10 minutes at a temperature of about 650 degrees F. In yet other embodiments, for example, decorative design 120 may be applied to inner side 112*b* of outer transparent panel 112 using a ceramic frit process as is known in the art.

In yet other embodiments, to aid in the adhesion of the white ink to outer transparent panel 112, prior to step 1006, masking may be applied to non-tin side of outer transparent panel 112 which masks off any areas where decorative design 120 is not to be printed. The masking reduces or prevents the amount of ultraviolet (UV) light that is absorbed by outer transparent panel 112 thus increasing or maximizing the amount of ultraviolet (UV) light absorbed by decorative design 120. This may aid in curing decorative design 120 to outer transparent panel 112 so that decorative design 120 does not get damaged during subsequent manufacturing steps. The masking may be a single mask or multiple mask portions applied to outer transparent panel 112.

Applying the decorative design 120 to outer transparent panel using a flatbed printer has several advantages over prior art edge-lit doors. First, the cost and complexity of using an additional transparent panel, such as acrylic, between outer and inner transparent panels are avoided. By not requiring an etched acrylic panel, embodiments of the present disclosure can be manufactured using existing double pane panel construction methods and machines. Second, the cost and complexity of etching a decorative design into a transparent panel are avoided. By using a flatbed printer to apply the decorative design 120, a variety of different decorative designs 120 can be used for different customers without requiring significant change-over costs or retooling. Additionally, if desired, multi-colored decorative designs may be applied to outer and/or inner transparent panels 112, 114, which is not possible with etched decorative designs.

Also, applying the decorative design 120 to inner side 112*b* of outer transparent panel 112 protects decorative design 120 from damage or destruction. That is, after outer and inner transparent panels 112, 114 are manufactured into transparent panel assembly 110, decorative design 120 is inaccessible. Thus, decorative design cannot be scratched, wiped off, or otherwise defaced or removed. Therefore, if decorative design 120 is a logo of a particular company, the logo cannot be removed.

As stated above, although white ink is preferred, embodiments of the door and method of making described herein can be used with any color ink without departing from the scope of the disclosure.

As an alternative to using a printer capable of printing UV curable ink, other processes may be used to apply the decorative design to the outer and/or inner transparent panels 112, 114. For example, one such alternative process is digitally printing the panel using thermally cured ceramic ink. This process typically involves a digital printer, such as an AR Series Printer from Dip-Tech Digital Printing Technologies Ltd., which prints the decorative design onto the glass surface. The ceramic ink is then cured thermally in a tempering oven so that the ink bonds to the glass surface.

Another alternative process is a silk-screening process in which ceramic ground glass frit with a coloring agent is sprayed through a pre-designed screen to achieve a desired pattern. During such a process, the ground glass frit is embedded into the panel during a tempering or heat strengthening cycle such that the frit becomes an integral component of the glass panel. Both epoxy and enamel coloring agents may be used with this silk-screening process.

Referring again to FIGS. 1-7, the internal construction of edge-lit door 100 is described in detail. Door 100 is made of a door shell 102 which is substantially rectangular in shape. Door 100 further includes perimeter channel 130 in which transparent panel assembly 110 is retained. Perimeter channel 130 has front wall 132, rear wall 134 and perimeter wall 136 therebetween. Front and rear walls 132, 134 are preferably perpendicular to perimeter wall 136. Accordingly, perimeter channel 130 is substantially U-shaped and is located proximate the opening in door shell 102.

Perimeter channel 130 is formed of a population of elongate primary panel retention members 140 and a population of elongate secondary panel retention members 160 inserted into the population of primary panel retention members 140. Preferably, four primary panel retention members 140 are attached to the back side of door shell 102 and four secondary panel retention members 160 are attached to the four primary panel retention members 140. Each of the primary and secondary panel retention members 140, 160 have miter cut ends and cooperate to form a frame. When attached or secured to one another, the four primary and four secondary panel retention members 140, 160 form continuous perimeter channel 130 Accordingly, the population of primary and secondary panel retention members 140, 160 and a population of spacers 202 retain transparent panel assembly 110 in door shell 102.

Refrigerator unit 10 includes top, bottom, left, and right primary panel retention members 140. Although reference is made to a single primary panel retention member 140, it will be understood that each of the top, bottom, left, and right primary panel retention members are substantially similar or identical in cross-sectional shape to one another. Top and bottom primary panel retention members 140 may have different lengths than left and right primary panel retention members 140. With reference to the illustrated orientation of the cross-section of primary panel retention member 140 in FIG. 6, primary panel retention member 140 includes first wall portion 146, second wall portion 148 extending substantially perpendicular to first wall portion 146, and third wall portion 150 extending substantially perpendicular to second wall portion 148. As shown, second wall portion 148 is substantially horizontal, with first wall portion 146 extending downward from the left side of second wall portion 148 and third wall portion 150 extending upward from the right side of second wall portion 148. First wall portion 146 terminates in a first door shell receiving portion 142. Third wall portion 150 terminates in a second shell receiving portion 144. Third wall portion 150 of primary panel retention member 140 further includes perimeter gasket barb receiving channel 154. Second wall portion 148 further includes ribbed barb receiving channel 152 for receiving a barbed portion 166 of secondary panel retention member 160 as described more fully below. Primary panel retention member 140 is attached to door shell 102 by sliding primary panel retention member 140 onto door shell 102 such that front wall 104 of door shell 102 is inserted into first door shell receiving portion 142 and back wall 106 of door shell 102 is inserted into second door shell receiving portion 144. Refrigerator unit 10 further includes top, bottom, left, and right secondary panel retention members 160 which are attached to top, bottom, left and right primary panel retention members 140, respectively. Although reference is made to a single secondary panel retention member 160, it will be understood that each of the top, bottom, left, and right secondary panel retention members 160 are substantially similar or identical in cross-sectional shape to one another. Top and bottom secondary panel retention members 160 may have different lengths than left and right secondary panel retention members 160. With reference to the illustrated orientation of the cross-section of secondary panel retention member 160 in FIG. 6, secondary panel retention member 160 includes first wall portion 162, barbed portion 166 extending substantially perpendicular to first wall portion 162, second wall portion 164 extending substantially perpendicular to first wall portion 162, and third wall portion 168 extending substantially perpendicular to second wall portion 164. As shown, barbed portion 166 and second wall portion 164 are substantially horizontal, with first wall portion 162 extending downward from the left side of second wall portion 164 and third wall portion 168 extending upward from the right side of second wall portion 164.

Secondary panel retention member 160 is secured to primary panel retention member 140 by inserting barbed portion 166 of secondary panel retention member 160 into ribbed barb receiving channel 152. Barbed portion 166 of secondary panel retention member 160 is inserted into ribbed barb receiving channel 152 until third wall portion 168 of secondary panel retention member 160 contacts third wall portion 150 of primary panel retention member 140. That is, third wall portion 168 acts as a stop to set the distance between first wall portion 146 of primary panel retention member 140 and first wall portion 162 of secondary panel retention member 160. The ribs inside ribbed barb receiving channel 154 assist in retaining the barbs of barbed portion 166 in place thus reducing or preventing movement of secondary panel retention member 160.

In certain embodiments, the ribs on ribbed barb receiving channel 154 and the barbs on barbed portion 166 may be eliminated. Accordingly, an alternative securing device may be used to attach secondary panel retention member 160 to primary panel retention member 140 including, but not limited to, tabs and corresponding slots, adhesives, screws, rivets, pins, etc.

With all four secondary panel retention members 160 attached to all four primary panel retention members 140, primary and secondary panel retention members 140, 160 cooperate to form perimeter channel 130 for retaining transparent panel assembly 110. Accordingly, the first wall portions 146 of the primary panel retention members 140 form front wall 132 of perimeter channel 130 and second wall portions 148 of primary panel retention members 140 form perimeter wall 136 of perimeter channel 130. The first wall portions 162 of secondary panel retention members 160 form rear wall 134 of perimeter channel 130.

With continued reference to FIG. 6, transparent panel assembly 110 is retained in door 100 by first and second panel retention members 140, 160 as described above. Also as described above, transparent panel assembly 110 includes outer transparent panel 112 having a decorative design 120 applied to the inner side 112*b* thereof. Outer transparent panel 112 is then edge-lit using a light source. Preferably, the light source is a strip of light-emitting diodes (LEDs) 200. LED strip 200 may comprise a linear array of individual light-emitting diodes mounted to a conductive strip. The LEDs are connected to a source of electrical current (not shown). Light-emitting diode strips 200 are placed on the top and bottom edges of outer transparent panel 112 and thus emit light into outer transparent panel 112. The light emitted from LED strips 200 thus travels in a direction substantially parallel to the plane of outer transparent panel 112. That is, outer transparent panel 112 functions as a light guide that will transmit the emitted light between outer and inner sides 112*a*, 112*b* of outer transparent panel 112. Decorative design 120 catches the light emitted by LED strips and redirects or reflects at least a portion of the emitted light. Decorative design 120 therefore illuminates, creating a pleasing and inviting appearance which may attract potential purchasers or consumers of the food products and/or beverages in storage compartment 24 of refrigerator unit 10.

Although, the light sources are described herein as LEDs, it will be understood that alternative light sources may be used to edge-light outer and/or inner transparent panels 112, 114 including, but not limited to, electroluminescent (EL) wire or tape, fluorescent lights, neon lights, etc. Furthermore, any color of light may be used. For example, the light source may emit a red light, a green light, a blue light, or any combination thereof. Additionally, the light source may have the ability to change colors. For example, LED strip 200 may be able to emit red light, green light, blue light, white light and may be able to transition between these colors an any other color in the visible spectrum.

LED strips 200 are located on the top and bottom edges of outer transparent panel 112; however in other embodiments, for example, LED strips 200 may additionally be located on the left and right edges of outer transparent panel 112. In yet other embodiments, LED strips 200 may only be located on the left and right edges of outer transparent panel 112. The location of LED strips 200 may depend on the shape of the decorative design. For certain shapes of decorative designs, a uniform light reflection may not be achieved by outer transparent panel 112 being edge-lit from the top and bottom edges and thus outer transparent panel 112 may additionally need to be edge-lit from the left and right edges. Alternatively, a uniform light reflection may be achieved by outer transparent panel 112 being edge-lit from only the left and right edges. It will be understood that light sources at any combination of edges of outer transparent panel 112 and/or inner transparent panel 114 are within the scope of the present disclosure. For example, outer transparent panel 112 may be edge-lit from the top and bottom edges, the top and right edges, the top and left edges, the bottom and right edges, the bottom and left edges, and the left and right edges. Additionally, in embodiments where inner transparent panel 114 is edge-lit, inner transparent panel 114 may be edge-lit from the top and bottom edges, the top and right edges, the top and left edges, the bottom and right edges, the bottom and left edges, and the left and right edges. Furthermore, in embodiments where both outer and inner transparent panels 112, 114 are edge-lit, the outer and inner transparent panels 112, 114 may be edge-lit from different edges. For example, outer transparent panel 112 may be edge-lit from the top and bottom edges and inner transparent panel 114 may be edge-lit from the left and right edges.

In yet other embodiments, one or more LED strips 200 may be used on any edge of outer transparent panel 112 and/or inner transparent panel 114 to emit different color light. For example, if a company logo has a red top portion and a blue bottom portion, an LED strip capable of emitting red light may be placed at the top edge of outer transparent panel 112 and an LED strip capable of emitting blue light may be placed at the bottom edge of outer transparent panel 112. Additionally or alternatively, one or more LED strips may be placed on left and right edges of outer transparent panel 112. Thus first LED strips capable of emitting red light may be placed on the left and right edges of outer transparent panel 112 and second LED strips capable of emitting blue light may be placed below the first LED strips on the left and right edges of outer transparent panel 112. Thus the red light is emitted from both the left and right edges to the top portion of the company logo and blue light is emitted from both the left and right edges to the bottom portion of the company logo.

To ensure contact between LED strip 200 and the edges of outer transparent panel 112, an light source retention strip 180 and spring 204 are further provided. Light source retention strip 180 includes an elongate horizontal body 182 with first and second vertical fingers 184, 186 extending downward from elongate horizontal body 182. First and second vertical fingers 184, 186 terminate in chamfered ends which are adapted to pierce and insert slightly into spacer bar 116 of transparent panel assembly 110. Spacer bar 116 may be made of, for example, hot melt butyl, foam, rubber, or plastic, thus first and second vertical fingers 184, 186 may easily insert into spacer bar 116. A stop 188 may be provided on second vertical finger 186 to control the depth of insertion of first and second vertical fingers 184, 186 into spacer bar 116. This assists in maintaining the correct distance between elongate horizontal body 182 and the edge of outer transparent panel 112 so that LED strip 200 fits properly between the edge of transparent panel 112 and elongate horizontal body 182. LED strip 200 is sandwiched between the edge of outer transparent panel 112 and elongate horizontal body 182 of light source retention strip 180.

As shown in FIGS. 6 and 7, two springs 204 are sandwiched between elongate horizontal body 182 of light source retention strip 180 and second wall portion 148 of primary panel retention member 140. Preferably, the top and bottom edges of outer transparent panel 112 are edge-lit and therefore LED strips 200, light source retention strips 180 and springs 204 are included at the top and bottom of door 100. Springs 204 provide a spring force acting to push the LEDs of LED strip 200 against the edge of outer transparent panel 112 which aids in the transmission of light into outer transparent panel 112. If there is a gap between the LEDs of LED strip 200 and the edge of outer transparent panel 112 the amount of light transmitted into outer transparent panel 112 is reduced resulting in decorative design 120 being dimly lit or not lit at all. Springs 204 further provide impact protection to transparent panel assembly 110 and LED strip 200 such that during manufacture, shipment, and/or use of refrigerator unit 10, transparent panel assembly 110 and LED strip 200 are not damaged. For example, if during shipment of refrigerator unit 10, refrigerator unit 10 is bumped or jostled, transparent panel assembly 110, LED strip 200 and light source retention strip 180 can move vertically relative to door shell 102 and primary and secondary panel retention members 140, 160.

Although two springs 204 are shown above the top of transparent panel assembly 110, it will be understood that fewer than two springs or more than two springs may be used on the top, bottom, left and or right sides of transparent panel assembly 110 without departing from the scope of the disclosure (e.g., 1 spring, 2 springs, 3 springs, 4 springs, 5 springs, etc.). Spring 204 is preferably a leaf spring; however it will be understood that in other embodiments, for example, a coil spring may be used. In yet other embodiments, spring 204 may be replaced by or supplemented with a bushing. The bushing may be made of a variety of rubbers including, but not limited to, polyurethane, ethylene propylene (EPM), ethylene propylene diene (EPDM), silicone, or any known natural and/or synthetic rubber.

Furthermore, spacer 202 may be placed between first wall portion 146 of primary panel retention member 140 and outer transparent panel 112. Spacer 202 may be used so that LED strip 200 can be placed directly on the edge of outer transparent panel 112 without interfering with primary panel retention member 140. It will be understood that in some embodiments for example, primary panel retention member 140 may be modified to include an integral spacer such that spacer 202 is not required.

Figure 9:
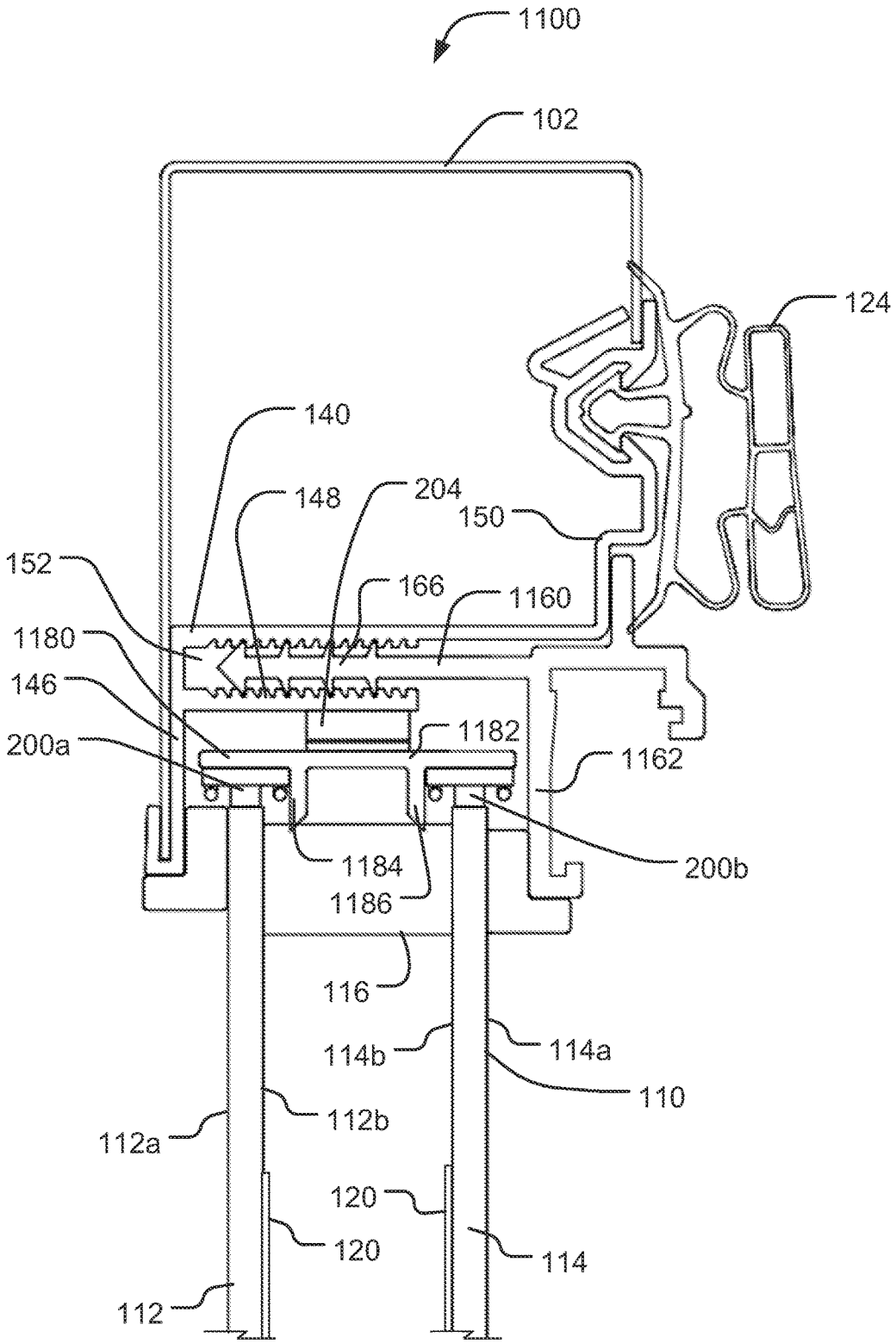
FIG. 9 is a right section view of a door for a refrigerator unit according to a second embodiment of the disclosure.

Referring now to FIG. 9, an alternative embodiment of door 100*a* is illustrated wherein both outer transparent panel 112 and inner transparent panel 114 have decorative designs 120 (shown with an enlarged thickness for illustrative purposes only) applied thereto and both outer transparent panel 112 and inner transparent panel 114 are edge-lit. Accordingly, a decorative design 120 may be applied to the inner sides 112*b*, 114*b* of outer and inner transparent panels 112, 114 using the process described more fully elsewhere herein. The decorative designs 120 on outer and inner transparent panels 112, 114 may be the same decorative design 120 or may be different decorative designs. In certain embodiments, the decorative designs 120 may be complementary such that when viewed as a whole the decorative design on outer transparent panel 112 and the decorative design on inner transparent panel 114 appear as a cohesive, complementary and/or coordinated decorative design. For example, the outline of a bottle may be applied to inner side 112*b* of outer transparent panel 112 and the logo or name of the product may be applied to inner side 114*b* of inner transparent panel 114. Additionally, the two different designs may be edge-lit with different colors to create a more pleasing or enticing decorative design. For example, the outline of the bottle may be edge-lit with red light and the logo or name of the product may be edge-lit with white light.

As further shown in FIG. 9, door 1100 includes door shell 102, primary panel retention member 140 attached to door shell 102, a perimeter gasket 124 attached to primary retention member 140, and secondary panel retention member 1160. Secondary panel retention member 1160 is substantially similar in construction to secondary panel retention member 160. However, the dimensions of secondary panel retention member 1160 are such that when barbed portion 166 of secondary panel retention member 1160 is inserted into ribbed barb receiving channel 152 of primary panel retention member 140, the distance between first wall portion 146 of primary panel retention member 140 and first wall portion 1162 of secondary panel retention member 1160 is sufficient to permit a first LED strip 200*a* on the edge of outer transparent panel 112 and a second LED strip 200*b* on the edge of inner transparent panel 114.

Accordingly, door 1100 includes first LED strip 200*a* which transmits light into outer transparent panel 112 and second LED strip 200*b* which transmits light into inner transparent panel 114. First and second LED strips 200*a*, 200*b* may emit the same color or they may emit different colors.

To ensure contact between first and second LED strips 200*a*, 200*b* and the edges of outer and inner transparent panels 112, 114, respectively, a light source retention strip 1180 and spring 204 are further provided. Light source retention strip 1180 includes an elongate horizontal body 1182 with first and second vertical fingers 1184, 1186 extending downward from elongate horizontal body 1182. First and second vertical fingers 1184, 1186 terminate in chamfered ends which are adapted to pierce and insert slightly into spacer bar 116 of transparent panel assembly 110. Spacer bar 116 may be made of, for example, hot melt butyl, foam, rubber, or plastic, thus first and second vertical fingers 1184, 1186 may easily insert into spacer bar 116. First and second LED strips 200*a*, 200*b* are sandwiched between the edges of outer and inner transparent panels 112, 114, respectively, and elongate horizontal body 1182 of light source retention strip 1180. Again, two springs 204 are sandwiched between elongate horizontal body 1182 of light source retention strip 1180 and second wall portion 148 of primary panel retention member 140.

In yet other embodiments, a door for a refrigerator unit may be made having more than two transparent panels (e.g., 3 transparent panels, 4 transparent panels, 5 transparent panels, etc.) with some or all of the transparent panels having a decorative design applied thereto and being edge-lit. In one embodiment, for example, a refrigerator unit may include a door having three transparent panels with each transparent panel having a decorative design applied thereto and each transparent panel being edge lit. In other embodiment, for example, a refrigerator unit may include a door having three transparent panels with only the middle transparent panel having a decorative design applied thereto and only the middle transparent panel being edge lit. It will be understood that any combination of the population of transparent panels may have a decorative design applied thereto and may be edge-lit without departing from the scope of the disclosure.

Thus, there has been shown and described novel methods and apparatuses of a refrigerator unit having an edge-lit door with a decorative design. It will be apparent, however, to those familiar in the art, that many changes, variations, modifications, and other uses and applications for the subject devices and methods are possible. All such changes, variations, modifications, and other uses and applications that do not depart from the spirit and scope of the disclosure are deemed to be covered by the disclosure which is limited only by the claims which follow.

The invention claimed is:

1. A door for a refrigeration unit comprising:

a transparent panel assembly comprising an outer transparent panel and an inner transparent panel, the outer transparent panel having an outer side, an inner side, and top, bottom, left, and right edges and the inner transparent panel having an outer side, an inner side, and top, bottom, left, and right edges, wherein a first decorative design is applied to the inner side of the inner transparent panel;

a rectangular door shell;

a perimeter channel located in the door shell, the perimeter channel having a front wall, a rear wall, and a perimeter wall, wherein the transparent panel assembly is retained within the perimeter channel;

a front spacers between the front wall of the perimeter channel and the outer side of the outer transparent panel;

a first population of light sources positioned on at least one of the top, bottom, left or right edges of the inner transparent panel capable of emitting light into the inner transparent panel;

a spacer bar proximate the top, bottom, left, and right edges of the outer and inner transparent panels, the spacer bar connecting the inner sides of the outer and inner transparent panels; and a population of light source retention members contacting the first population of light sources, wherein the population of light source retention members include a population of chamfered fingers adapted to be inserted a depth into the spacer bar of the transparent panel assembly;

wherein the first decorative design is capable of being illuminated by the first population of light sources.

2. The door of claim 1, further comprising:

a second decorative design applied to the inner side of the outer transparent panel; and a second population of light sources positioned on at least one of the top, bottom, left or right edges of the outer transparent panel capable of emitting light into the outer transparent panel; wherein the second decorative design on the outer transparent panel is capable of being illuminated by the second population of light sources on the outer transparent panel.

3. The door of claim 1, further comprising a rear spacer between the rear wall of the perimeter channel and the outer side of the inner transparent panel.

4. The door of claim 1, wherein the perimeter channel is formed by:

a population of primary panel retention members attached to the rectangular door shell, each of the population of primary panel retention members having a first wall portion and a second wall portion extending substantially perpendicular to the first wall portion, wherein the first wall portions form the front wall of the perimeter channel and the second wall portions form the perimeter wall; and a population of secondary panel retention members attached to the population of primary panel retention members, each of the population of secondary panel retention members having a first wall portion, wherein the first wall portions of the secondary panel retention members form the rear wall of the perimeter channel.

5. The door of claim 4, wherein each of the population of primary panel retention members further comprise a ribbed receiving channel and each of the population of secondary panel retention members further comprise a barbed portion, wherein the ribbed receiving channels of the primary panel retention members are adapted to receive the barbed portions of the secondary panel retention members.

6. The door of claim 1, wherein each of the population of light source retention members further comprise a stop adapted to contact at least one of the top, bottom, left or right edge of the outer or inner transparent panels for controlling the depth of insertion of the population of chamfered fingers.

7. The door of claim 6, further comprising a population of springs contacting the population of light source retention members and the perimeter wall of the perimeter channel, wherein the population of springs provides a spring force to maintain the population of light sources in contact with at least one of the top, bottom, left or right edges of the outer or inner transparent panels.

8. The door of claim 1, wherein the decorative design is applied by a printing process.

9. The door claim 8, wherein the decorative design is formed of ultraviolet (UV) curable ink.

10. The door of claim 9, wherein the decorative design comprises a layer of primer applied to the inner side of the inner transparent panel and a layer of ink applied to the layer of primer.

11. The door of claim 1, wherein the decorative design is applied by a silk-screening processing using ceramic frit.

12. The door of claim 1, wherein the decorative design is applied by a digital printing process using thermally cured ceramic ink.

13. The door of claim 2, wherein the first and second population of light sources are capable of emitting a single color of light.

14. The door of claim 2, wherein the first and second population of light sources are capable of emitting multiple colors of light.

15. The door of claim 2, wherein a first subset of the first population of light sources is capable of emitting a first color of light and wherein a second subset of the second population of light sources is capable of emitting a second color of light.

16. The door of claim 1, wherein the first population of light sources are positioned on the top edge of the inner transparent panels.

17. The door of claim 1, wherein the first population of light sources are positioned on the bottom edge of the inner transparent panels.

18. The door of claim 1, wherein the first population of light sources are positioned on the left edge of the inner transparent panels.

19. The door of claim 1, wherein the first population of light sources are positioned on the right edge of the inner transparent panels.

20. The door of claim 1, wherein the door is rotatably mounted to a cabinet comprising a storage compartment and refrigeration system components capable of refrigerating the storage compartment.

21. A door for a refrigeration unit comprising:

a rectangular door shell;

a perimeter channel located in the door shell, the perimeter channel having a front wall, a rear wall, and a perimeter wall;

a transparent panel assembly retained within the perimeter channel, the transparent panel assembly comprising:

an outer transparent panel having an outer side, an inner side, and top, bottom, left, and right edges;

an inner transparent panel having an outer side, an inner side, and top, bottom, left, and right edges; and a spacer bar proximate the top, bottom, left, and right edges of the outer and inner transparent panels, the spacer bar connecting the inner sides of the outer and inner transparent panels;

a population of light sources positioned on at least one of the top, bottom, left or right edges of the outer or inner transparent panels capable of emitting light into the outer or inner transparent panels; and a population of light source retention members contacting the population of light sources, wherein the light source retention members comprise a population of chamfered fingers adapted to be inserted a depth into the spacer bar of the transparent panel assembly.

22. A refrigeration unit comprising:

a cabinet having a storage compartment and refrigeration system components capable of refrigerating the storage compartment; and a door mounted to the cabinet, the door comprising:

a rectangular door shell;

a perimeter channel located in the door shell, the perimeter channel having a front wall, a rear wall, and a perimeter wall;

a transparent panel assembly retained within the perimeter channel, the transparent panel assembly comprising:

an outer transparent panel having an outer side, an inner side, and top, bottom, left, and right edges;

an inner transparent panel having an outer side, an inner side, and top, bottom, left, and right edges; and a spacer bar proximate the top, bottom, left, and right edges of the outer and inner transparent panels, the spacer bar connecting the inner sides of the outer and inner transparent panels;

a population of light sources positioned on at least one of the top, bottom, left or right edges of the outer or inner transparent panels capable of emitting light into the outer or inner transparent panels; and a population of light source retention members contacting the population of light sources, wherein the population of light source retention members further comprise a population of chamfered fingers adapted to be inserted a depth into the spacer bar of the transparent panel assembly.

23. The refrigeration unit of claim 22, further comprising a first decorative design applied to the inner side of the outer transparent panel.

24. The refrigeration unit of claim 23, further comprising a second decorative design applied to the inner side of the inner transparent panel.

25. The refrigeration unit of claim 22, further comprising a first decorative design applied to the inner side of the outer transparent panel and a second decorative design applied to the inner side of the inner transparent panel.

26. The refrigeration unit of claim 23, further comprising a front spacer between the front wall of the perimeter channel and the outer side of the outer transparent panel.

27. The refrigeration unit of claim 23, further comprising a rear spacer between the rear wall of the perimeter channel and the outer side of the inner transparent panel.

28. The refrigeration unit of claim 23, wherein the perimeter channel is formed by:

a population of primary panel retention members attached to the rectangular door shell, each of the population of primary panel retention members having a first wall portion and a second wall portion extending substantially perpendicular to the first wall portion, wherein the first wall portions form the front wall of the perimeter channel and the second wall portions form the perimeter wall;

a population of secondary panel retention members attached to the population of primary panel retention members, each of the population of secondary panel retention members having a first wall portion, wherein the first wall portions of the secondary panel retention members form the rear wall of the perimeter channel.

29. The refrigeration unit of claim 28, wherein each of the population of primary panel retention members further comprise a ribbed receiving channel and each of the population of secondary panel retention members further comprise a barbed portion, wherein the ribbed receiving channels of the primary panel retention members are adapted to receive the barbed portions of the secondary panel retention members.

30. The refrigeration unit of claim 22, wherein each of the population of light source retention members further comprise a stop adapted to contact at least one of the top, bottom, left or right edge of the outer or inner transparent panels for controlling the depth of insertion of the population of chamfered fingers.

31. The refrigeration unit of claim 30, wherein the population of springs comprise leaf springs.

32. The refrigeration unit of claim 23, wherein the first decorative design is applied by a printing process.

33. The refrigeration unit of claim 32, wherein the first decorative design is formed of ultraviolet (UV) curable ink.

34. The refrigeration unit of claim 33, wherein the first decorative design comprises a layer of primer applied to the inner side of the outer or inner transparent panel and a layer of ink applied to the layer of primer.

35. The refrigeration unit of claim 23, wherein the first decorative design is applied by a silk-screening processing using formed of ceramic frit.

36. The refrigeration unit of claim 23, wherein the first decorative design is applied by a digital printing process using thermally cured ceramic ink.

37. The refrigeration unit of claim 22, wherein the population of light sources are capable of emitting a single color of light.

38. The refrigeration unit of claim 22, wherein the population of light sources are capable of emitting multiple colors of light.

39. The refrigeration unit of claim 22, wherein a first subset of the population of light sources is capable of emitting a first color of light and wherein a second subset of the population of light sources is capable of emitting a second color of light.

40. The refrigeration unit of claim 22, wherein the population of light sources are positioned on the top edge of the outer or inner transparent panels.

41. The refrigeration unit of claim 22, wherein the population of light sources are positioned on the bottom edge of the outer or inner transparent panels.

42. The refrigeration unit of claim 22, wherein the population of light sources are positioned on the left edge of the outer or inner transparent panels.

43. The refrigeration unit of claim 22, wherein the population of light sources are positioned on the right edge of the outer or inner transparent panels.

* * * * *